US006772772B2

(12) United States Patent
Connors et al.

(10) Patent No.: US 6,772,772 B2
(45) Date of Patent: Aug. 10, 2004

(54) METHOD FOR CLEANING AN EXHAUST GAS RECIRCULATION SYSTEM

(75) Inventors: David L. Connors, Export, PA (US); Daniel P. Degnan, Venetia, PA (US); Harold E. Erwin, Augusta, KS (US)

(73) Assignee: BG Products, Inc., Wichita, KS (US)

( * ) Notice: Subject to any disclaimer, the term of this patent is extended or adjusted under 35 U.S.C. 154(b) by 0 days.

(21) Appl. No.: 10/159,162

(22) Filed: May 31, 2002

(65) Prior Publication Data

US 2002/0144715 A1 Oct. 10, 2002

Related U.S. Application Data

(63) Continuation of application No. 09/343,139, filed on Jun. 29, 1999, now Pat. No. 6,478,036.

(60) Provisional application No. 60/119,236, filed on Feb. 9, 1999, and provisional application No. 60/111,741, filed on Dec. 10, 1998.

(51) Int. Cl.[7] ..... B08B 3/02; B08B 3/04; B08B 9/00; B08B 9/027; F02B 77/04

(52) U.S. Cl. ..... 134/22.18; 134/22.1; 134/22.11; 134/22.12; 134/24; 134/39; 134/42

(58) Field of Search ..... 134/20, 22.1, 22.11, 134/22.12, 22.18, 24, 39, 42, 100.1, 169 A, 166 R, 166 C, 198, 102.2

(56) References Cited

U.S. PATENT DOCUMENTS

| | | | |
|---|---|---|---|
| 4,989,561 | A | 2/1991 | Hein et al. |
| 5,232,513 | A | 8/1993 | Suratt et al. |
| 5,485,857 | A | 1/1996 | Amundsen |
| 5,503,683 | A | 4/1996 | Butcher et al. |
| 5,692,461 | A | 12/1997 | Crovato et al. |
| 5,826,602 | A | 10/1998 | Chen |

OTHER PUBLICATIONS

1996 Parts Catalog of BG Products, Inc.

Brochure entitled: Wynn's Equipment & Tools, Wynn Oil Company brochure, 9M1133. It is unknown whether or when the brochure was actually published, 1998.

*Primary Examiner*—Zeinab El-Arini
(74) *Attorney, Agent, or Firm*—Shook, Hardy & Bacon L.L.P.

(57) ABSTRACT

A method and apparatus for cleaning the EGR system of a vehicle is disclosed. The apparatus includes an induction device that is removably attachable to the manifold of an engine in the location of the EGR valve. The induction device includes an adapter plate and a nozzle assembly. The apparatus further includes a solvent administrator removably attachable to the induction device for providing a quantity of solvent to the EGR system.

6 Claims, 3 Drawing Sheets

METHOD FOR CLEANING AN EXHAUST GAS RECIRCULATION SYSTEM

CROSS REFERENCE TO RELATED APPLICATIONS

This application is a continuation of and claims the benefit of U.S. application Ser. No. 09/343,139 now U.S. Pat. No. 6,478,036, filed Jun. 29, 1999 which claims the benefit of U.S. Provisional Application No. 60/111,741, filed Dec. 10, 1998, and U.S. Provisional Application No. 60/119,236, filed Feb. 9, 1999.

STATEMENT REGARDING FEDERALLY SPONSORED RESEARCH OR DEVELOPMENT

Not applicable.

BACKGROUND OF THE INVENTION

This invention relates to the maintenance of automobile internal combustion engines and, more particularly, to a method and apparatus for cleaning an exhaust gas recirculation system on such engines.

Exhaust gas recirculation ("EGR") systems were first used on motor vehicles in the early 1970's and have become well-known in the art. Broadly viewed, EGR systems remove a portion of the exhaust gas from the exhaust manifold and reroute the gas back to the combustion chamber. This rerouted gas cools the chamber and dilutes the oxygen content in the chamber to control detonation. An EGR valve opens to release the rerouted exhaust gas into the combustion process, and controls the combustion temperature and the timing of the engine to achieve optimum efficiency.

The EGR process initiates as exhaust gas is pulled from the manifold through a thin tube, thereby cooling the gas. A vacuum created in the engine pulls the gas through a computer-controlled EGR valve into a collection chamber where it further cools. In this chamber, entrained heavy particulate matter of unburned carbon particles are released, causing carbon deposits to accumulate over time within the EGR system. The deposits primarily affect the functioning of the EGR valve, which controls the volume and timing of the recirculation of the exhaust gas. If a sufficient amount of such deposits accumulate, the chamber and the valve will become inefficient and produce an overly rich fuel mixture to the engine. The engine control system will then attempt to correct for this over rich mixture, but will eventually fail. Thus, the carbon deposits reduce not only the efficiency of the EGRsystem, but also the functioning of the combustion engine as a whole.

The carbon deposit buildup in the EGR system has been recognized by those in the industry as a significant problem. Several manufacturers have distributed service bulletins providing maintenance individuals with methods of eliminating the deposits. The most common method involves drilling holes into the manifold to gain access to the manifold. Once access to the manifold is achieved, the maintenance individual places a foreign object into the manifold, such as a coat hanger, and then vigorously moves the hanger within the manifold. The movement of the foreign object within the manifold is intended to dislodge the deposits and allow them to circulate through the system. Not only is this an extremely time consuming and crude exercise, but it also poses a serious hazard to the engine.

First, this proposed maintenance does not eliminate the deposits, but merely causes them to become dislodged and moved to other portions of the engine. The deposit debris can accumulate on the valves or spark plugs of the engine, causing them to function improperly or, in some instances, to become inoperable. Second, the insertion of the foreign object into the manifold will often create metal slivers or shavings from the object. The existence of these metal slivers or shavings in the engine can be deleterious to the functioning of the engine. Whether the deposits and shavings accumulate on the valves, spark plugs or cylinder walls, the result is the possibility of serious damage to the vehicle engine.

The other common method prescribed by automobile manufacturers to clean the EGR system is to physically remove the manifold assembly and the submerge it in a cleaning liquid. This process is extremely time consuming and expensive. This method requires that the vehicle be out of service for an extended period of time, which is undesirable to the vehicle owner.

SUMMARY OF THE INVENTION

It is therefore an objective of the present invention to provide a method and apparatus for cleaning the EGR system of a vehicle that is effective, but simple and inexpensive to perform. More particularly, it is an object of the present invention to provide a method and apparatus for cleaning the EGR system of a vehicle employing a solvent that dissolves the carbon deposits within the system so that they may be eliminated without the risk of creating deposit debris.

Still more particularly, it is an object of the present invention to provide a method and apparatus for cleaning the EGR system of a vehicle that administers atomized solvent to the EGR system to break down and dissolve carbon deposits throughout the manifold.

It is another object of present invention to provide a method and apparatus for cleaning the EGR system of a vehicle that does not require the drilling of access holes into the engine.

It is also an object of present invention to provide a method and apparatus for cleaning the EGR system of a vehicle that does not require the dismantling and flushing of the EGR components.

It is yet another object of the present invention to provide a method and apparatus for cleaning the EGR system of a vehicle that employs adaptor plates conforming to the existing configurations of EGR valves on conventional combustion engines so that the method and apparatus can be used on any commercially produced vehicle.

It is an overall object of the present invention to provide a system for cleaning the EGR system of a vehicle that overcomes the deficiencies of other methods currently used in the art.

To accomplish these and other related objects, a method and apparatus for cleaning the EGR system of a vehicle is disclosed. The apparatus includes an induction device that is removably attachable to the manifold of an engine in the location of the EGR valve. The induction device includes a venturi cap defining a central cavity and having multiple circumferential bores for accessing ambient air. The apparatus further includes a solvent, having a composition of chemicals for dissolving the deposits within the EGR system, and a solvent administrator removably attachable to the induction device for providing a quantity of solvent to the EGR system. Finally, the present invention includes supplemental steps for ensuring the EGR system is completely cleaned and maintained for subsequent use.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENT

Figure 1:
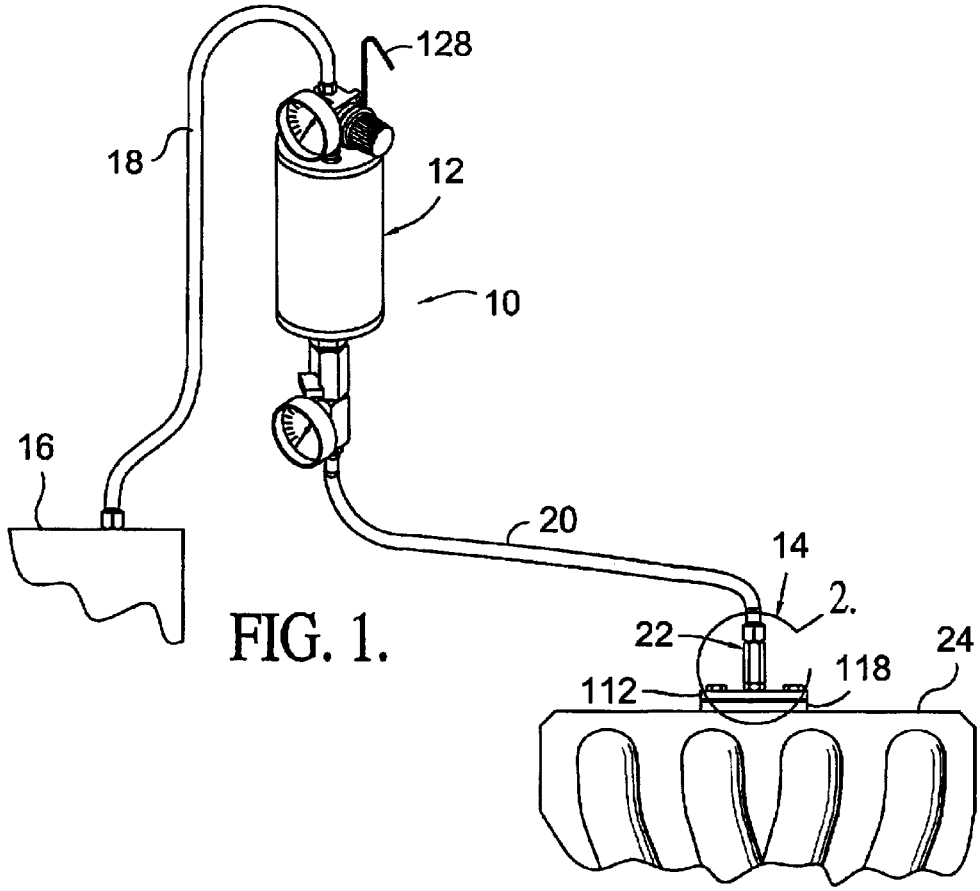
FIG. 1 is a perspective view of one embodiment of the present invention, shown coupled to an air supply source and the manifold of a vehicle.

An apparatus for cleaning the EGR system of a combustion engine is broadly designated in the drawings by the reference numeral 10. With initial reference to FIG. 1, apparatus 10 includes three components: a solvent (not shown), a solvent administrator 12, and an induction device 14.

In one embodiment of the present invention, administrator 12 is supplied with pressurized air from an air supply source 16 via an air supply hose 18. This pressurized air assists in forcing the solvent through administrator 12 and into a solvent hose 20. Hose 20 is connected to the lower end of administrator 12 on one end and is connected to a nozzle assembly 22 of induction device 14 on its other end. As best seen in FIG. 1, induction device 14 is coupled to a manifold 24 of the vehicle being serviced. As is more fully described below, the above-described arrangement allows solvent from administrator 12 to be advantageously introduced to manifold 24 to clean and remove unwanted deposits therefrom.

Figure 3:
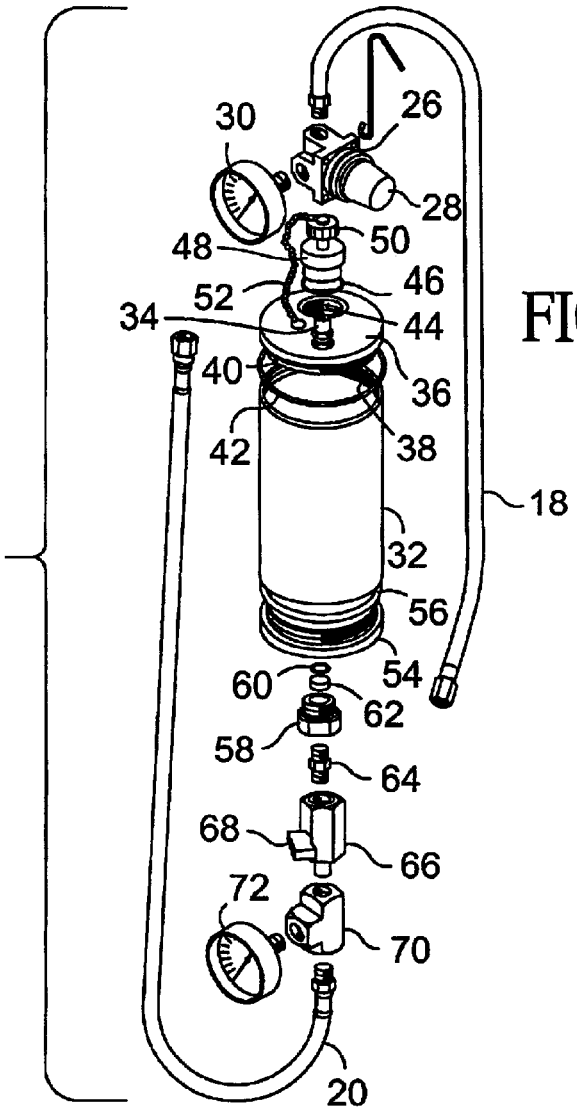
FIG. 3 is an exploded view of the solvent administrator of FIG. 1.

As best seen in FIG. 3, administrator 12 includes a regulator 26 which communicates with air supply hose 18. More specifically, hose 18 may be connected on one end to air supply source 16 and may be connected on its opposite end to regulator 26. Regulator 26 is equipped with an adjustment knob 28 and a pressure gauge 30. Knob 28 is used adjust the air pressure flowing into administrator 12 and gauge 30 is used to monitor the level of air pressure.

Regulator 26 communicates with a main body 32 of administrator 12 through a check valve 34 installed in a top 36. Top 36 is secured to main body 32 utilizing threads 38 and 40. Additionally, an o-ring 42 may be provided between top 36 and body 32 to provide a seal between the two components.

As best seen in FIG. 3, top 36 is provided with a threaded and centered vent hole 44. An o-ring 46 is placed into hole 44 and a vent cap 48 is threaded into hole 44. Vent cap 48 includes a pressure release valve 50 which may be opened to bleed off pressure within body 32. Cap 48 may be secured to top 36 with a chain arrangement 52 to insure that it does not fall into the engine being serviced or otherwise become lost.

As with the top of administrator 12, a bottom 54 is threaded into main body 32. An o-ring 56 is placed between bottom 54 and body 32 to seal the two components together. Bottom 54 is equipped with a threaded and centered through hole into which is screwed a fitting 58. Prior to installing fitting 58, an o-ring 60 and a pill filter 62 may be installed in bottom 54 and held in place with fitting 58. Secured within the lower end of fitting 58 is a check valve 64. Valve 64 is preferably threaded into fitting 58. The lower end of valve 64 is threaded into a ball valve 66. Valve 66 is equipped with an on/off toggle handle 68. Handle 68 may be positioned to either allow or prevent the flow of solvent from administrator 12 into solvent hose 20. Following valve 66 is a tee fitting 70 that is coupled to ball valve 66 on one end thereof. Solvent hose 20 is coupled to the opposite end of tee 70. A pressure gauge 72 is installed in the remaining port of tee 70. The preferred solvent administrator 12 described above is the 9210 tool offered by BG Products, Inc. of Wichita, Kans. Alternatively, the 9220 tool offered by BG Products, Inc., may also be used. These tools are commercially available. While these tools are preferred, it is to be understood that other administrator tools capable of metering out solvent to the EGR system may also be used and are within the scope of the present invention. Such tools should provide predetermined volumes of solvent to induction device 14 either through the suction provided by the engine vacuum or under pressure, if necessary.

Figure 2:
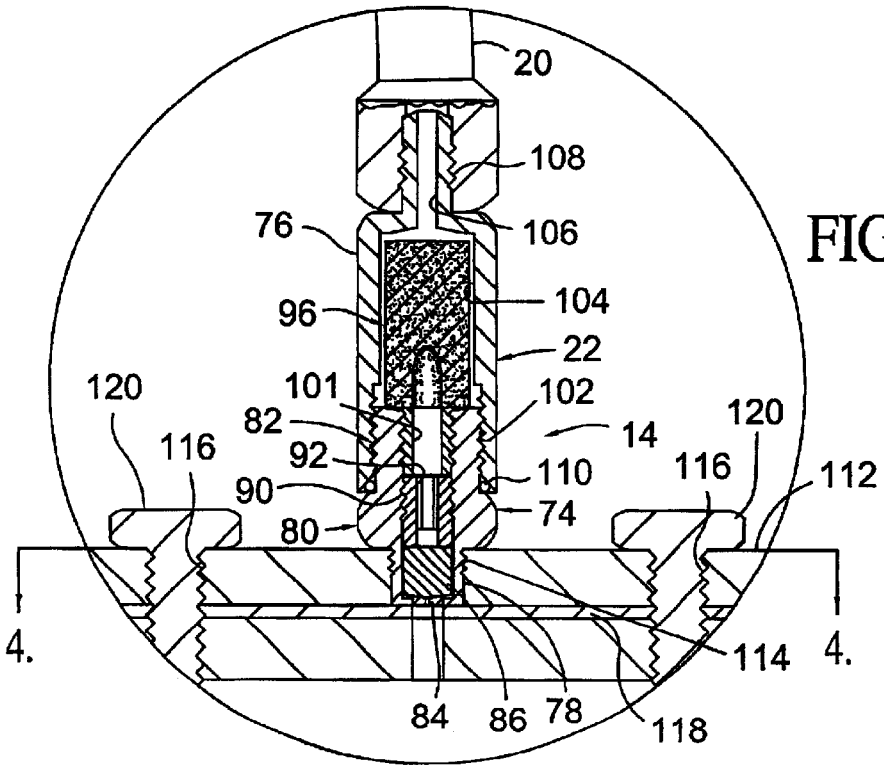
FIG. 2 is an enlarged view of the area encircled by line 2—2 of FIG. 1, shown in cross-section.
Figure 6:
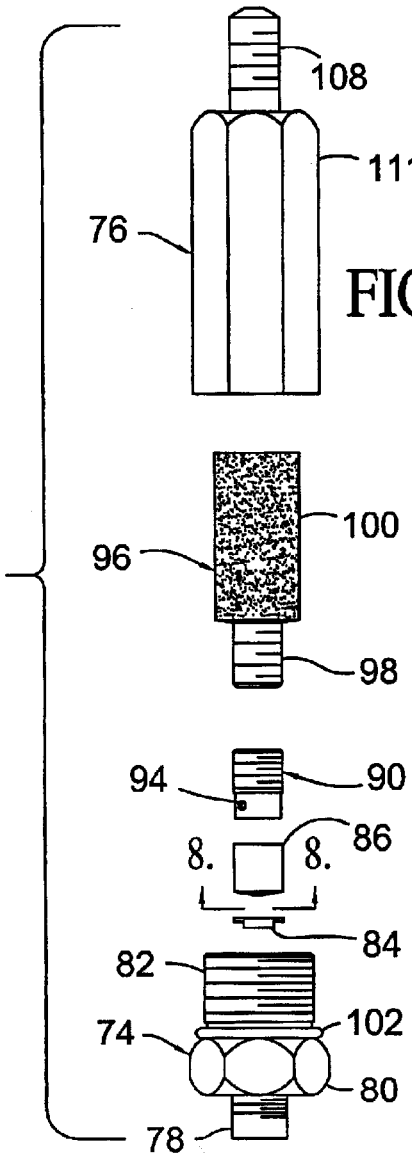
FIG. 6 is an exploded view of an alternate embodiment of one component of the present invention.

In the embodiment described above, solvent hose 20 is coupled with induction device 14 shown in FIG. 2. As shown, device 14 includes nozzle assembly 22. Assembly 22 is equipped with a lower fitting 74 and an upper fitting 76. As best seen in FIGS. 2 and 6, lower fitting 74 has a lower section 78 which is externally threaded. Section 78 has an axial through hole which allows communication between the exterior of fitting 74 and the interior thereof. Lower section 78 transitions to a hexagonal middle section 80. The provision of section 80 allows lower fitting 74 to be installed with a wrench, as is more fully described below. Middle section 80 transitions to an upper externally threaded section 82. Upper section 82 is also equipped with internal threads. The external threads of upper section 82 allow upper fitting 76 to be installed on lower fitting 74.

Figure 4:
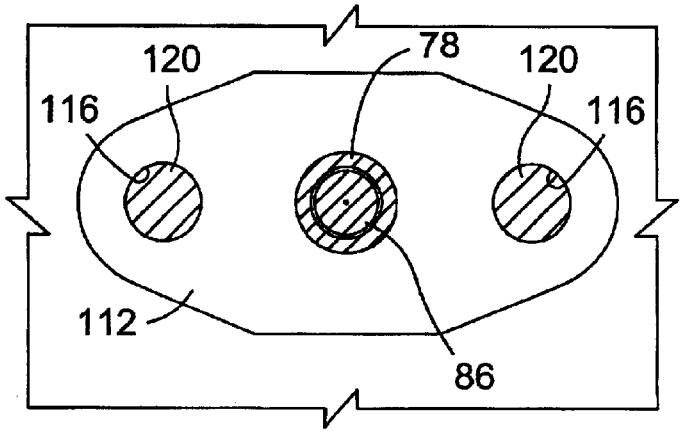
FIG. 4 is a cross-sectional view taken along line 4—4 of FIG. 2.
Figure 8:
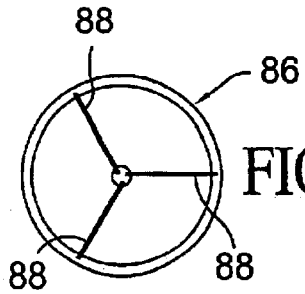
FIG. 8 is a bottom plan view taken along line 8—8 of FIG. 6.

As best seen in FIG. 6, installed within lower section 78, and more specifically within the internal bore thereof, is a cylindrical jet 84. Jet 84 has a very small hole through the center thereof. The solvent and air mixture is allowed through this hole, as is more fully described below. Situated directly on top of jet 84, and within the internal bore of lower section 78, is a seat 86. As best seen in FIG. 4, seat 86 is preferably of slightly smaller diameter than the internal bore within lower section 78, so that fluid is allowed to travel around the seat and between the seat and the inner wall of lower section 78. Further, as best seen in FIG. 8, seat 86 is equipped with flow channels 88 which direct the fluid to the hole within jet 84. Further installed in the lower section 78 is a partial plug 90. Plug 90 has external threads that allow it to be threaded within lower fitting 74. Plug 90 has an internal hexagonal cavity 92 which allows plug 90 to be tightened with a hexagonal wrench. Two fluid holes 94 are provided which allow fluid to travel from the interior of plug 90 to the exterior thereof.

Threaded into the internal threads of upper section 82 above plug 90 is an atomizer 96. Atomizer 96 has a lower threaded section 98 and an upper atomizing section 100. As best seen in FIG. 2, atomizer 96 has an internal cavity 101 that is positioned to allow fluid flow into cavity 92 of plug 90. Atomizer 96 allows fluid communication between the exterior thereof and the internal cavity 101 through a large number of very small poles or channels. This construction transforms the liquid solvent to a gas and liquid mixture.

Once all of the components are installed within lower fitting 74, upper fitting 76 is threaded onto lower fitting 74. As best seen in FIG. 2, upper fitting 76 thus has a lower internally threaded section 102 above which is an open cavity 104. Cavity 104 communicates with solvent hose 20 through an upper channel 106. Upper fitting 76 has an upper externally threaded section 108 which allows upper fitting 76 to be coupled to solvent hose 20. As best seen in FIG. 2, when upper fitting 76 and lower fitting 74 are coupled together, an o-ring 110 may be used to further seal the two components. To promote assembly and disassembly using a wrench, upper fitting 76 includes a hexagonally shaped outer portion 111 proximate to the upper section 108.

Nozzle assembly 22 is coupled to an adaptor plate 112. Plate 112 is preferably made from a lightweight and sturdy material, such as aluminum. An internally threaded hole 114 is provided in plate 112, into which is threaded lower section 78 of lower fitting 74. Further, adaptor plate 112 is equipped with a pair of bolt holes 116. Holes 116 are spaced such that plate 112 may be coupled to manifold 24 in the location of a removed EGR valve. Therefore, the size and configuration of holes 116 and plate 112 will vary corresponding to the vehicle manifold. Further, plate 112 has an outer dimension conforming to the configuration of the seat region of the EGR valve. There are currently at least six seat region configurations for use on commercially manufactured automobile engines. Thus, there are at least six current adaptor plates for use in connection with the present invention. Only one of the six adaptor plate configurations is shown. However, it is within the common experience and knowledge of those skilled in the art to construct and select the adaptor plate conforming to the seat region configuration of a particular engine. It is anticipated that other configurations will be used by manufacturers in the future and, thus, conforming adaptor plates are within the scope of the present invention.

A sealing gasket 118 is placed between plate 112 and manifold 24 prior to installation. Gasket 118 is adapted to fit between the plate 112 and manifold 24 when the induction device 14 is secured in place. The gasket promotes a secure, airtight and liquid tight seal between the induction device 14 and the engine. After the cleaning process is complete, the gasket will be used with the EGR valve when the valve is remounted to the manifold. Adaptor 112 is held in place on manifold 24 with a pair of mounting bolts 120 which are the same bolts used that are used to secure the EGR valve to the manifold.

Figure 5:
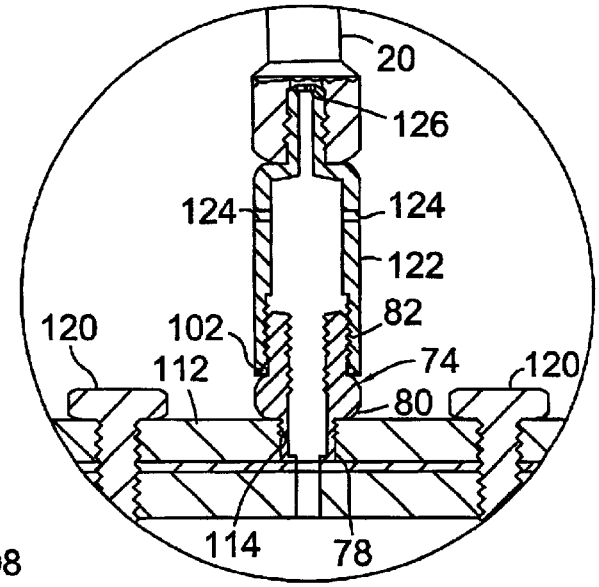
FIG. 5 is a view similar to FIG. 2, illustrating an alternate embodiment of the present invention.
Figure 7:
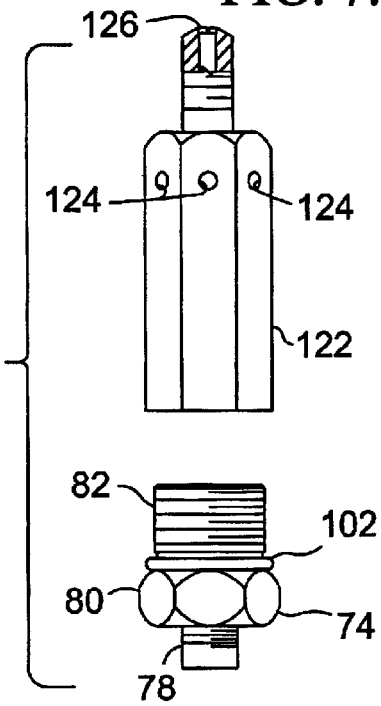
FIG. 7 is a view similar to FIG. 6, showing an exploded view of an alternate embodiment of one component of the present invention.

In an alternate embodiment of the present invention, air supply hose 18 is not coupled to air supply source 16, but rather is left uncoupled. In this embodiment, the major difference in the equipment used is in nozzle assembly 22. In this embodiment, as best seen in FIGS. 5 and 7, lower fitting 74 is used, but without jet 84, seat 86, partial plug 90 and atomizer 96. Instead, as best seen in FIG. 5, an upper fitting 122 is used which has a plurality of radially spaced air holes 124 extending through the upper fitting. Air holes 124 are preferably located near the upper end of fitting 122. In the preferred embodiment, there are six circumferential 118 inch diameter bores in the flat surfaces of the hexagonal body. It is to be understood, however, that a different number and size of bores could be utilized. The size and number of bores is a matter of simple optimization within the ability of one skilled in the art. As best seen in FIG. 7, fitting 122 is equipped with a jet 126 in its upper most end. Jet 126 is equipped with a small through hole, generally of the same diameter as that used in jet 84. In this embodiment, jet 126 acts in concert with air holes 124 to create a solvent and air mixture or vapor that is introduced into the vehicle engine, as is more fully described below.

The preferred solvent of the present invention is a solvent offered by BG Products, Inc. and sold under the name BG 211 Induction System Cleaning, BG Part 211. The composition of the solvent is readily ascertainable from the label of the product. While this BG 211 solvent is the preferred solvent of the system, it is to be understood that other solvents capable of dissolving carbon deposits may also be used and are within the scope of the present invention.

To use the apparatus of the present invention, it is advisable that the manufacture's recommended test procedures first be used to determine whether the EGR valve is properly functioning. Once the EGR valve is determined to be operational, it is removed from the engine. The EGR valve is typically bolted to the manifold using two bolts. The EGR valve also includes vacuum and exhaust tubes and electrical leads, which must be removed. The tubes are then plugged. Typically, the exhaust port on the manifold will be covered and blocked by the adaptor plate on the induction device. If it is not, the port must be plugged with a supplemental bolt or other plugging member. Solvent administrator 12 is suspended above the vehicle engine, such as on the hood of the vehicle. For this purpose, a hook 128 is provided, as best seen in FIG. 1.

The appropriate adaptor plate 112 is then selected to conform to the seat region of the EGR valve. Gasket 118 is then aligned over the bolt holes in the manifold. Induction device 114, fully assembled, is secured to the manifold over the gasket with bolts 120, which are the same bolts that are used to secure the EGR valve to the manifold. It is critical that the induction device orifice overlie the intake manifold port when mounted. If it does not, the incorrect plate has been chosen.

The EGR system is then tested to determine if total blockage exists. First, engine of the vehicle is started. A piece of paper is then placed near the air holes 124 of upper fitting 122. The paper should be pulled against the fitting 122 due to the vacuum of the engine. If there is insufficient vacuum to pull the paper, the system is considered plugged.

To unplug the system, the nozzle assembly 22, with fitting 122, must be removed and replaced with a nozzle assembly 122 having fitting 76 therein, which does not have air holes 124. Air supply hose 18 is then connected to air supply 16. Approximately ⅓ of a can of solvent is added to solvent administrator 12 and 20 psi of pressure is applied. Solvent administrator 12 is then attached to induction device 14 with the ball valve 66 closed. The engine is started and ball valve 66 is then opened. To check the system, ball valve 66 is closed periodically. If the pressure, indicated by gauge 30, drops to zero within 5–10 seconds, the unplugging process is considered complete. If the pressure drop is not rapid, the process is repeated. In this embodiment, as seen in FIG. 2, the solvent travels from solvent hose 20 into upper fitting 76. More specifically, the solvent travels through upper channel 106 and into upper cavity 104. The solvent is then forced to travel through atomizing section 100 and into inner cavity 101. From cavity 101, the atomized solvent mixture travels into cavity 92 of plug 90. The atomized solvent then travels through fluid holes 94 and between the space defined by seat 86 and the inner diameter of threaded section 78. Finally, the atomized solvent travels through flow channels 88 and exits nozzle assembly 22 through jet 84.

After unplugging the system or if the system is initially determined to be unplugged, the cleaning procedure is initiated. Induction device 14, equipped with upper fitting 122 is mounted to the manifold. Solvent is placed in body 32 of administrator 12. Next, solvent hose 20 is attached to upper fitting 122. Solvent administrator 12 is vented, through vent cap 48, to prevent a vacuum from forming inside administrator 12 as the product is pulled from administrator 12 and through device 14 by the vacuum from the running engine.

To allow a better connection between solvent administrator 12 and induction device 14, an L-shaped shoulder valve adapter joint can be utilized. The shoulder valve merely allows reorientation by ninety degrees, to promote easier installation.

The engine of the vehicle is started once apparatus 10 is assembled and secured in place. Once started, ball valve 66 connecting solvent administrator 12 to induction device 14 is opened. This will introduce solvent to the device 14. The downstroke of the pistons in the engine creates a vacuum within the manifold causing the ambient air to be sucked into inductor 14 device via air holes 124 in upper fitting 122, thereby atomizing the solvent passing through jet 126 within the central cavity. The in-flowing air atomizes the solvent and the resulting air/solvent mixture proceeds into the combustion chamber. The fog of air/solvent mixture dissolves the carbon deposits inside the EGR chamber and washes the residue away. The residue of the carbon deposits goes to the combustion chamber where it is combusted and eliminated.

After approximately ten minutes of administration, solvent administrator 12 is shut off by closing valve 66, thereby preventing further passage of solvent to the induction device. The vehicle engine is then stopped. Induction device 14 is then removed from the manifold and the EGR valve is then remounted according to the manufacturer's specifications with appropriate hoses and leads.

As described above, primarily, administrator 12 provides solvent to induction device 14 utilizing gravity plus the force of the vacuum created by the engine through a solvent hose. This preferred method utilizes upper fitting 122. If, however, the vacuum and gravity forces are insufficient, the induction device 14 may be fitted with upper fitting 76 and pressure may be applied from the pressurized source 16 to move the solvent through the system.

The method of the present invention contemplates two follow-up procedures to complete the cleaning process of the EGR system. First, after administration of the EGR cleaning method, the plenum is cleaned by applying the atomized chemical to the air intake from the throttle plates. The plenum can be cleaned with either the BG AIS Cleaning Tool Kit, Part No. 9206, or with the BG Air Intake System Cleaner, Part No. 406. Both products are commercially available.

Finally, a can of BG Products, Inc. 44K product, Part No. 208, is added to the fuel tank of the vehicle, which serves to remove any residual deposits. The plenum cleaning is an important component of the cleaning process, while the fuel additive component is optional.

Cleaning the EGR system using the method and apparatus of the present invention requires only about 20 to 30 minutes and employs very simple tools. Carbon deposits impeding the function of the EGR system are broken down by the solvent and, thus, do not pass to other parts of the engine where they can cause damage. The system does not require that the EGR system be dismantled from the vehicle, thereby saving time and expense. The various adapter plates allow for the system to be used with virtually any manufactured vehicle on the market. The system overcomes the deficiencies of the prior art and allows for maintenance of the EGR system in an easier, safer and more efficient manner.

The following is claimed:

1. A method for cleaning the EGR system of a combustion engine, said engine having an EGR valve and an EGR valve seat, said method comprising the steps of:

providing an induction device having a member conforming to the EGR valve seat;

providing a solvent to the induction device;

administering the solvent to the EGR system through the induction device; and terminating the administration of the solvent after said solvent has been administered for a sufficient amount of time to adequately clean said EGR system.

2. The method of claim 1, wherein the solvent is atomized prior to being administered to said EGR system.

3. The method of claim 1, further comprising pressurizing the solvent being administered to said EGR system.

4. A method for cleaning the EGR system of a combustion engine, said system having an EGR valve and an EGR valve seat, said method comprising:

providing a member through which solvent can be administered which conforms to the EGR valve seat on the engine;

removing the EGR valve from the engine;

attaching said member to the engine at the EGR valve seat; and administering solvent through the member into the EGR system to clean said EGR system.

5. The method of claim 4, further comprising the step of inserting a gasket between said member and said EGR valve seat to form a seal that is substantially impermeable to fluids.

6. The method of claim 4, comprising the additional steps of:

terminating the administration of solvent after said solvent has been administered for a sufficient amount of time to adequately clean said EGR system;

removing said member, and replacing said EGR valve.

* * * * *